US007276152B2

(12) United States Patent
Lin et al.

(10) Patent No.: US 7,276,152 B2
(45) Date of Patent: Oct. 2, 2007

(54) OXIDATIVE DESULFURIZATION AND DENITROGENATION OF PETROLEUM OILS

(75) Inventors: Tzong-Bin Lin, Chiayi (TW); Hsun-Yi Huang, Chiayi (TW); Jyh-Haur Hwang, Taichung County (TW); Hung-Chung Shen, Chiayi (TW); Karl Tze-Tang Chuang, Edmonton (CA)

(73) Assignee: CPC Corporation, Taiwan, Taipei (TW)

( * ) Notice: Subject to any disclaimer, the term of this patent is extended or adjusted under 35 U.S.C. 154(b) by 295 days.

(21) Appl. No.: 10/996,402

(22) Filed: Nov. 23, 2004

(65) Prior Publication Data

US 2006/0108263 A1 May 25, 2006

(51) Int. Cl.
*C10G 17/02* (2006.01)
*C10G 17/10* (2006.01)

(52) U.S. Cl. ..... 208/219; 208/208 R; 208/237; 208/240; 208/254 R; 549/528; 562/5

(58) Field of Classification Search ..... 208/208 R, 208/219, 237, 240, 254 R; 549/528; 562/5
See application file for complete search history.

(56) References Cited

U.S. PATENT DOCUMENTS

| | | | | |
|---|---|---|---|---|
| 3,236,883 A | | 2/1966 | Losch | |
| 3,278,562 A | * | 10/1966 | Schnizer et al. | 549/528 |
| 3,719,589 A | | 3/1973 | Herbstman | |
| 4,097,364 A | | 6/1978 | Egan | 208/111 |
| 4,097,520 A | * | 6/1978 | Slattery | 562/5 |
| 4,113,661 A | | 9/1978 | Tamm | 252/465 |
| 4,430,203 A | | 2/1984 | Cash | 208/210 |
| 4,639,308 A | | 1/1987 | Lee | 208/100 |
| 4,757,042 A | | 7/1988 | Threlkel | 502/112 |
| 4,976,848 A | | 12/1990 | Johnson | 208/251 |

(Continued)

FOREIGN PATENT DOCUMENTS

| | | |
|---|---|---|
| EP | 0 565 324 A1 | 10/1993 |
| EP | 1 004 576 A1 | 5/2000 |

(Continued)

OTHER PUBLICATIONS

Otsuki, Shujiro, et al., "Oxidative Desulfurization of Light Gas Oil and Vacuum Gas Oil by Oxidation and Solvent Extraction", Energy & Fuels 2000, 14, 1232-1239.

(Continued)

*Primary Examiner*—Glenn Caldarola
*Assistant Examiner*—Prem C. Singh
(74) *Attorney, Agent, or Firm*—Cascio, Schmoyer & Zervas

(57) ABSTRACT

A robust, non-aqueous, and oil-soluble organic peroxide oxidant is employed for oxidative desulfurization and denitrogenation of hydrocarbon feedstocks including petroleum fuels. Even at low concentrations, the non-aqueous organic peroxide oxidant is extremely active and fast in oxidizing the sulfur and nitrogen compounds in the hydrocarbon feedstocks without catalyst. Consequently, the oxidation reactions that employ the non-aqueous organic peroxide oxidant take place at substantially lower temperatures and shorter residence times than reactions in other oxidative desulfurization and denitrogenation processes. As a result, a higher percentage of the valuable non-sulfur and non-nitrogen containing components in the hydrocarbon feedstock are more likely preserved with the inventive process. Desulfurization and denitrogenation occur in a single phase non-aqueous environment so that no phase transfer of the oxidant is required.

55 Claims, 4 Drawing Sheets

U.S. PATENT DOCUMENTS

| | | | | |
|---|---|---|---|---|
| 4,990,243 | A | 2/1991 | Winslow et al. | 208/254 |
| 5,059,304 | A | 10/1991 | Field | 208/99 |
| 5,071,805 | A | 12/1991 | Winslow et al. | 502/66 |
| 5,190,642 | A | 3/1993 | Wilson et al. | 208/254 |
| 5,294,332 | A | 3/1994 | Klotz | 208/120 |
| 5,324,417 | A | 6/1994 | Harandi | 208/113 |
| 5,770,761 | A | 6/1998 | Lin et al. | 560/231 |
| 6,160,193 | A | 12/2000 | Gore | 585/833 |
| 6,171,478 | B1 | 1/2001 | Cabrera et al. | |
| 6,180,557 | B1 | 1/2001 | Choudhary et al. | 502/224 |
| 6,274,785 | B1 | 8/2001 | Gore | 585/833 |
| 6,277,271 | B1 | 8/2001 | Kocal | |
| 6,402,940 | B1 | 6/2002 | Rappas | 208/240 |
| 6,406,616 | B1 | 6/2002 | Rappas et al. | 208/240 |
| 6,596,914 | B2 | 7/2003 | Gore et al. | |
| 6,673,235 | B2 | 1/2004 | Harris et al. | 208/120.01 |
| 2002/0035306 | A1* | 3/2002 | Gore et al. | 585/833 |
| 2003/0094400 | A1 | 5/2003 | Levy et al. | |
| 2004/0178122 | A1 | 9/2004 | Karas et al. | |

OTHER PUBLICATIONS

Froment, Gilbert F., et al., "Kinetic Modeling and Reactor Simulation in Hydrodesulfurization of Oil Fractions", Ind., Eng. Chem. Res. 1994, 33, 2975-2988.

Aida Tetsuo Oxy-desulfurization as a highly efficient process desulfurizing light oil, Nihon Enerugi Gakkaishi/J. JP Institute of Energy 1999, pp. 396-403, vol. 78, No. 6, Maruzen Co. LTD, Tokyo, Japan.

Lu, Tze-Fong et al., "Desulfurization of FCC Diesel Using H202 Organic Acids," *J. Uni. of Petroleum*, China 25(3), p. 26-29, Jun. 2001.

F.M. Collins et al., "Oxidative desulfurization of oils via hydrogen peroxide and heteropolyanion catalysis," J. of Molecular Catalysis A: Chemical 117 (1997) p. 397-403.

International Preliminary Report of Patentability, PCT/US2005/041101/Jun. 7, 2007.

* cited by examiner

OXIDATIVE DESULFURIZATION AND DENITROGENATION OF PETROLEUM OILS

FIELD OF THE DISCLOSURE

The present invention relates to an oxidative process for removing organic sulfur and nitrogen compounds from petroleum oils and to non-aqueous oxidants that are useful for the oxidative process. The process can be employed with transportation fuel streams to produce gasoline, jet fuel, and diesel, as well as with intermediate refinery streams including light cycle oil, hydrotreated and non-hydrotreated vacuum gas oil, atmospheric residual oil, and crude oil.

BACKGROUND OF THE INVENTION

Stringent U.S. environmental regulations will in the immediate future require that the level of sulfur in gasoline be reduced by 90% from the current 300 ppm to 30 ppm and those in diesel be reduced by 97% from the current 500 ppm to 15 ppm. Hydrotreating is most common method of removing organic sulfur and nitrogen compounds from petroleum fractions. In hydrotreating, oil and hydrogen are fed to a fixed bed reactor that is packed with a hydrodesulfurization (HDS) catalyst. The HDS operating temperature and pressure typically range from 600-700° F. and from 500 to 2,500 psig (pounds per square inch, gauge), respectively. The more difficult the sulfur removal needed, e.g., the higher the level of sulfur reduction, the more stringent the HDS operating temperatures and pressures become. In this regard, severe hydrotreating of gasoline feedstock to achieve low sulfur levels will saturate a significant portion of the olefins in the gasoline thereby substantially lowering the octane number. To minimize the octane loss, state of the art hydrotreating catalysts can isomerize the paraffins that are generated by olefin saturation. In a similar vein, it is expected that more robust catalysts must be developed and efficient process modifications implemented in order to remove the most refractory sulfur compounds. Most refiners have revamped their existing hydrotreating facilities and/or introduced new hydrotreating techniques in anticipation of these challenges as they comply with the new U.S. guidelines.

In recent years, industry has sought to develop less expensive desulfurization alternatives to hydrotreating. It is known that contacting a petroleum distillate to an oxidant converts sulfur and nitrogen compounds in the distillate into sulfones (or sulfoxides) and organic nitric oxides, respectively. These polar organic oxides can be removed from the distillate by solvent extraction and/or adsorption. More importantly, oxidative desulfurization can easily oxidize and remove thiophenic sulfur compounds, which cannot be readily treated by HDS due to the stereo hindrance effect around the sulfur atom in the molecule. For example, it has been reported that the activity of thiophenic compounds in responding to HDS treatment is in the following sequence: DBT (dibenzothiophene)>4 MDBT (4-methyl dibenzothiophene)>4,6 DMDBT (4,6-dimethyl dibenzothiophene). See, Ind Eng Chem Res, 33, pp 2975-88 (1994). In contrast, it has been reported that the activity of thiophenic compounds in responding to oxidative treatment is just the opposite, namely: 4,6 DMDBT>4 MDBT>DBT. See, Energy Fuels, 14, pp 1232-39 (2000). These observations suggest that oxidative desulfurization can be effective in removing the most difficult residual sulfurs from hydrotreated oils to yield ultra-low sulfur products.

The oxidants currently used in oxidative desulfurization include, for example, peroxy organic acids, catalyzed hydroperoxides and inorganic peroxy acids. Almost all peroxy organic acids are derived by oxidation of organic acids with hydrogen peroxide. For example, EP 1004576 A1 to Druitte discloses a process for producing peracetic acid (PAA) by reacting hydrogen peroxide and acetic acid (AA) in an aqueous reaction medium.

U.S. Pat. No. 6,160,193 to Gore discloses a method for removing sulfur and nitrogen compounds from petroleum distillates, such as light gas oil (diesel) by oxidation with a selective oxidant. The oxidants are divided into three categories: (1) hydrogen peroxide based oxidants, (2) ozone based oxidants, and (3) air or oxygen based oxidants. The preferred oxidant is PAA that is formed by oxidizing glacial AA with 30-50% aqueous hydrogen peroxide. Since the peroxide is in the aqueous phase, a phase transfer agent is required to carry the peroxide from the aqueous phase to the oil phase where it oxidizes the sulfur and nitrogen compounds. The phase transfer, which is the rate-limiting step, significantly slows down the reaction rates. In this case, AA is the phase transfer agent for the oxidation of the sulfur and nitrogen compounds in the light gas oil. A small but not insignificant amount of AA remains in the oil phase in the reactor effluent.

Another disadvantage of using the aqueous oxidant disclosed in U.S. Pat. No. 6,160,193 is that the presence of water in the reactor effluent prevents phase separation of oil from the aqueous acid when the oil feed is vacuum gas oil, atmospheric residual oil, crude oil, or other heavy hydrocarbons. Complicating matters is the fact that the sulfones generated in the oxidation reactor also function as surfactants to inhibit phase separation. The spent AA, which is equivalent to 7 to 10 wt % of the oil feed, cannot be effectively removed from the oil, treated, and recycled without phase separation. The presence of water can also cause a significant portion of the sulfones and organic oxides to precipitate from the reactor effluent. Indeed, solids may form at critical stages in the process thereby causing the valves, pumps, and even the adsorbent bed to malfunction. U.S. Pat. No. 6,160,193 does not appear to recognize the importance of the solid precipitation problem, which certainly occurs when the distillate contains more than 500 ppm sulfur and nitrogen compounds.

The specific solvents used to extract sulfones from the distillate phase in the process disclosed in U.S. Pat. No. 6,160,193 also tend to extract appreciable amounts of oil along with the sulfones and organic nitrogen oxides. The prior art has disclosed many solvents for the sulfones extraction, including dimethyl sulfoxide (DMSO), formic acid, nitromethane, dimethyl formamide (DMF) and trimethyl phosphate. See, for example, U.S. Pat. No. 6,160,193 to Gore, U.S. Pat. No. 6,274,785 to Gore, U.S. Pat. No. 6,402,940 to Rappas, U.S. Pat. No. 6,406,616 to Rappas et al., and EP 0565324 A1 to Aida. However, none of these solvents has proven to be cost effective in removing sulfones from the oil.

U.S. Pat. No. 6,402,940 to Rappas describes a process for desulfurizing fuels such as diesel oil to achieve a sulfur level of 2 to 15 ppm. The oxidant is hydrogen peroxide in a formic acid solution with no more than 25 wt % water. Since hydrogen peroxide is in an aqueous phase, the formic acid functions as the phase transfer agent that transfers the hydrogen peroxide to the oil phase. Given that formic acid is a more efficient phase transfer agent than acetic acid, the oxidation reaction rate is faster under formic acid. Nevertheless, phase transfer remains the rate-limiting step. A major drawbacks of the process is the spent acid recovery system. As described in the patent, the spent acid, which contains formic acid, water, sulfones, and trace amounts of diesel, is first fed to a flash distillation vessel to strip out the formic acid and water. The formic acid and water are then fed to an azeotropic distillation column. In this process, water is derived from oxidation reactions and from the aqueous hydrogen peroxide feed. Water must be removed from the spent formic acid stream in order to maintain the water balance in the process. It is known that formic acid and water form an azeotrope containing 77.5 wt % formic acid and 22.5 wt % water. However, according to the disclosed process, feed to the azeotropic distillation column contains more than 77.5 wt % formic acid. Consequently, the column could produce essentially pure formic acid in the overhead stream and about 77.5 wt % formic acid (but not pure water) in the bottom stream. In light of this, it would be impossible to remove water from the spent formic acid and it appears that the disclosed process is inoperable.

The presence of water in the reactor effluent also causes a significant portion of the sulfones and organic oxides to precipitate from the liquid phases and thereby disrupt the process. As mentioned earlier, water in the system also renders the process unsuitable for desulfurizing heavy hydrocarbons, such as vacuum gas oil, atmospheric resid, and crude oil, due to the difficulties in phase separation between oil and the aqueous acid.

SUMMARY OF THE INVENTION

The present invention is based, in part, on the development of a robust, non-aqueous, and oil-soluble organic peroxide oxidant that is particularly suited for oxidative desulfurization and denitrogenation of hydrocarbon feedstocks including petroleum fuels. Even at low concentrations, the non-aqueous organic peroxide oxidant is extremely active and fast in oxidizing the sulfur and nitrogen compounds in the hydrocarbon feedstocks. Consequently, the oxidation reactions that employ the non-aqueous organic peroxide oxidant take place at substantially lower temperatures and shorter residence times than reactions in other oxidative desulfurization and denitrogenation processes. As a result, a higher percentage of the valuable non-sulfur and non-nitrogen containing components in the hydrocarbon feedstock are more likely preserved with the inventive process. Desulfurization and denitrogenation occur in a single phase non-aqueous environment so that no phase transfer of the oxidant is required. Moreover, there is no appreciable amount of water in the system which would otherwise cause unexpected solids precipitation; indeed, the non-aqueous medium of the oxidant is also an excellent solvent for sulfones and organic nitrogen oxides that are produced. Furthermore, no phase separation is required for recycling the spent acid, which is the phase transfer agent used in prior art oxidative desulfurization methods. Another advantage of the invention is that the process generates recoverable organic acids, including AA, as a valuable by-product.

DETAILED DESCRIPTION OF THE PREFERRED EMBODIMENTS

Figure 1:
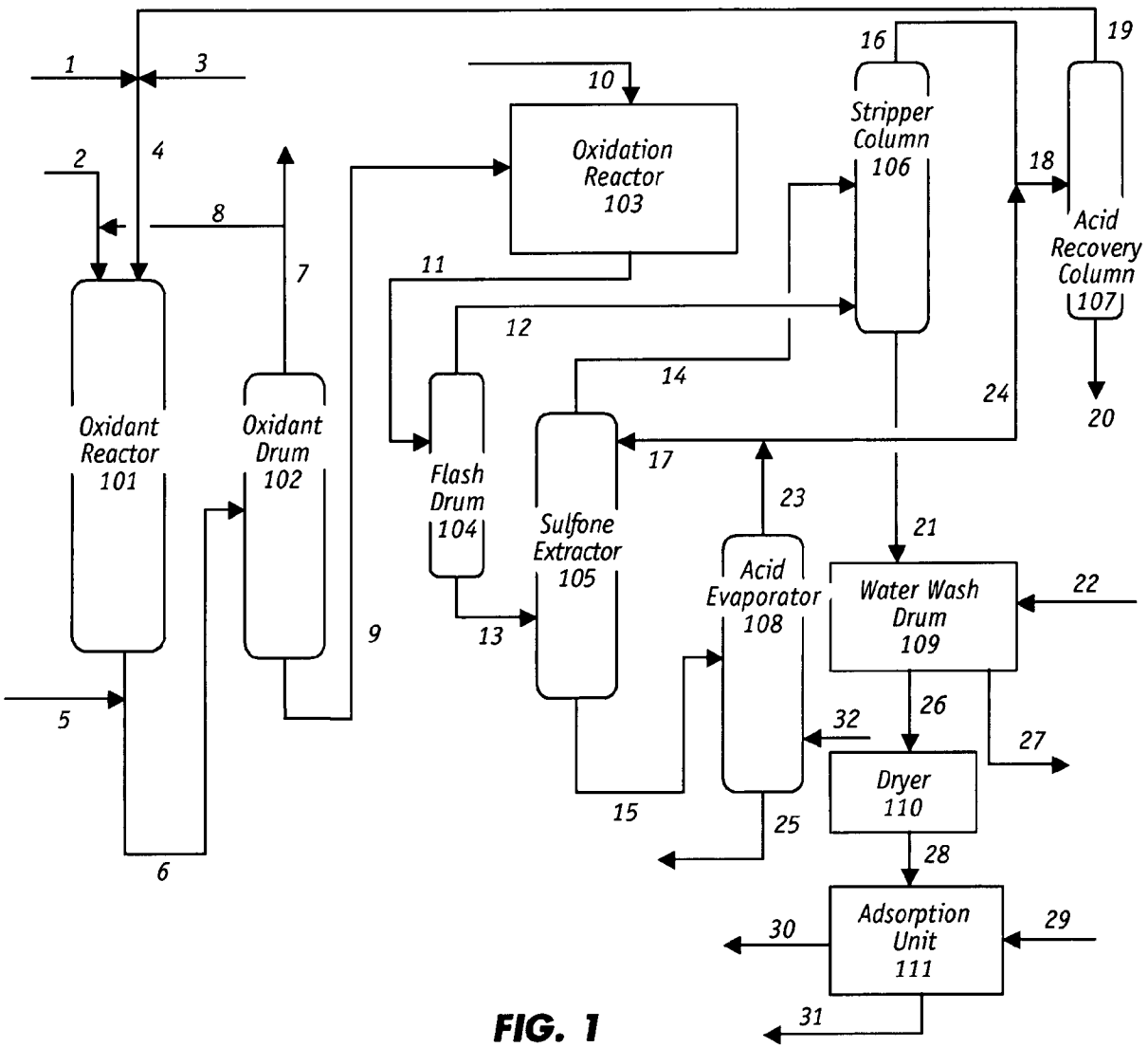
FIGS. 1 and 2 are schematic flow sheets of two alternative desulfurization and denitrogenation processes.

The present invention is directed to an oxidative desulfurization and denitrogenation process for removing sulfur and nitrogen compounds from hydrocarbon feedstocks that include, for instance, gasoline, diesel, vacuum gas oil, atmospheric residual oil and crude oil. The process employs a non-aqueous, oil-soluble peroxide oxidant to generate sulfones and organic nitrogen oxides that are extracted preferably with low-boiling point solvents.

Preparation of Peroxide Oxidant

The desulfurization and denitrogenation process of the present invention employs a peroxide oxidant having the formula RCOOOH where R represents hydrogen or the alkyl group. Preferably, the alkyl group is a lower akyl which includes both straight- and branched chain alkyl groups having a total of 1 through 6 carbons, preferably 1 through 4 carbons, and includes primary, secondary, and tertiary alkyl groups. Typical lower alkyls include, for example, methyl, ethyl, n-propyl, isopropyl, n-butyl, and t-butyl. Most preferably, R is methyl. The desulfurization and denitrogenation process can produce gasoline that contains 30 ppm sulfur or less and diesel that contains 15 ppm sulfur or less.

Peroxides having the formula RCOOOH where R represents hydrogen or an alkyl group are commercially available. Furthermore, methods for synthesizing the peroxides are known. For example, peracetic acid can be made by oxidizing acetic acid with hydrogen peroxide in aqueous solution and then removing essentially all the water from the oxidant by heating or other feasible means. The term "a non-aqueous, oil-soluble peroxide oxidant" or "non-aqueous peroxide oxidant" refers a peroxide of the above formula which is dissolved in an organic solvent or in a hydrocarbon feedstock. No significant amount of water is present in the organic solvent or hydrocarbon feedstock which would create an aqueous phase with a portion of the peroxide dissolved therein. In other words, the non-aqueous peroxide oxidant is in a single, organic-phase.

A preferred method of synthesizing the peroxide oxidants uses an organoiron catalyst which promotes the oxidation of aldehydes by molecular oxygen to form a peroxide according to the following reaction: $RCHO+O_2 \rightarrow RCOOOH$ where R represents hydrogen or an alkyl group, as described above.

The reaction is carried out under mild temperatures and pressures in a non-aqueous medium which is preferably an organic solvent that is non-reactive and that is a good solvent for the sulfones and organic nitrogen oxides that are formed in the oxidative process. The latter helps prevent solid precipitation in the reactor or other components in the process. The organic solvent is preferably also completely miscible with the hydrocarbon feedstock, e.g., oils. Particularly preferred organic solvents are ketones ($R_2O$). Typically, the amount of organic solvent employed is such that the weight ratio of RCHO reactant to organic solvent ($R_2O$) ranges from about 1:10 to 10:1 and preferably from about 1:1 to 1:4.

The organoiron catalysts are homogenous catalysts that are soluble in organic solvents and catalyze the oxidation of aldehydes by molecular oxygen to form a peroxide. Preferred organoiron catalysts include, for example, Fe(III) acetylacetonate (FeAA), Fe(III) ethylhexanoate (FeEHO), ferrocenyl methyl ketone (FeMK), and mixtures thereof. These are all commercially available. Typically, the catalyst concentration ranges from about 0.1 to 10,000 ppm (Fe) and preferably from about 0.1 to 10 ppm (Fe).

As an example of preparing PAA, acetaldehyde ($CH_3CHO$) is mixed in acetone ($CH_3OCH_3$) and the mixture contacted with oxygen to produce PAA ($CH_3COOOH$) through an oxidation reaction promoted by one or more of the organoiron catalysts. The organoiron catalysts were found to catalyzed oxidation of aldehydes directly to the corresponding peroxy organic acids with molecular oxygen at very mild reaction conditions. For acetaldehyde, the reaction temperature and pressure were typically from 0 to 100° C. and from 0 to 200 psig, respectively, and preferably, from 40 to 60° C. and from 50 to 150 psig, respectively. The impurities, mainly AA, can be minimized by designing the process to yield lower acetaldehyde conversions, i.e., by employing a lower PAA concentration in oxidant. It was unexpectedly discovered that the peroxide oxidant was so robust that oxidative desulfurization of the oils occurs even at low PAA concentrations. Minor amounts of AA and the unconverted acetaldehyde were found to have no effect on the subsequent oxidation reactions of sulfur and nitrogen in the oil feed.

Oxidation of Sulfur and Nitrogen Compounds

In oxidizing sulfur and nitrogen compounds in a hydrocarbon feedstock, the feedstock reacts with the peroxide oxidant in an oxidation reactor operating at low temperatures and pressures. The organic sulfur compounds are converted to sulfones and the organic nitrogen compounds are converted to nitrogen oxides in a single oil phase. When the feedstock is commercial diesel, essentially all the sulfur and nitrogen compounds will have to be oxidized in order to achieve a sulfur level of 15 ppm or less in the diesel product. For higher sulfur and nitrogen containing feeds, such as light cycle oil, vacuum gas oil, atmospheric residual oil, and crude oil, partial oxidation of sulfur and/or nitrogen may be desirable for economic reasons.

When the peroxide oxidant is PAA, the oxidation reaction produces AA as a by-product as the PAA molecule releases its activated oxygen atom in the reaction. Based on experiments conducted with a commercial diesel feed containing 500 ppm sulfur, it has been shown that in the oxidation process the PAA generates 3750 ppm (0.375 wt %) AA. This concentration of AA is substantially below its solubility limit in diesel, which is approximately 2 wt % at room temperature. As a result, no phase separation is observed. In the case where the concentration of AA is higher than 2 wt %, the solvent, e.g., acetone, in the initial oxidant composition also helps prevent phase separation, since the solvent is typically miscible in both the oil and AA. The oxidation reactions typically are carried out at a temperature and pressure of from about 0 to 150° C. and from about 0 to 200 psig, respectively, preferably, from about 20 to 80° C. and from about 0 to 50 psig, respectively.

Product Purification and Recovery

Following the oxidation reaction, the sulfones and organic nitrogen oxides are preferably removed from the product by solvent extraction. Thereafter, the product is purified. Suitable extraction solvents are preferably low boiling solvents with high affinity to the sulfones and organic nitrogen oxides. Preferred extraction solvents include, for example, ammonia, alcohols, and organic acids and particularly preferred solvents are ammonia, methanol, and AA. The AA that is generated in the oxidation reactor as a by-product in the oxidation reaction can be an excellent solvent for extracting the sulfones and nitrogen oxides from the oxidized feedstock. Moreover, the amount of AA that is generated as a by-product should be sufficient to extract the sulfones and nitrogen oxides. It is understood however that make-up AA can be added to the in situ generated AA as needed. As is apparent, the process flow for the overall oxidative desulfurization and denitrogenation using in situ AA as the extraction solvent is different from the process flow where extraction solvent is not AA.

Process Flow with In Situ Acetic Acid as the Extraction Solvent

FIG. 1 is a flow diagram of an oxidative desulfurization and denitrogenation process for treating oil wherein AA is used as the extraction solvent for removing the bulk of the sulfones and nitrogen oxides from the oxidized hydrocarbon feedstock, e.g., oxidized oil. The process employs an Oxidant Reactor 101, Oxidant Drum 102, Oxidation Reactor 103, Flash Drum 104, Sulfone Extractor 105, Stripper Column 106, Acid Recovery Column 107, Acid Evaporator 108, Water Wash Drum 109, Dry 110 and Adsorption Unit 11 as the major components. It should be noted that the "Oxidant Reactor" is where the oxidant, such as PAA is made, while the "Oxidation Reactor" is where the sulfur compounds and the nitrogen compounds in the oil feed are oxidized by the oxidant. The non-essential details of the process, such as the location of pumps, valves, heat-exchanger, heaters, coolers, compressors, vacuum equipment, and instrumentations are omitted for clarity. In this example, the peroxide oxidant is PAA which is prepared by reacting acetylaldehyde with oxygen in acetone. The reaction is catalyzed by iron(II) acetylacetonate (FeAA).

Referring to FIG. 1, a homogeneous solution of iron(III) acetylacetonate (FeAA), is introduced via line 1 into line 19, which contains the recycled acetone and acetaldehyde from the overhead of the Acid Recovery Column 107. Fresh acetaldehyde is also mixed with line 19 through line 3, and the combined stream (line 4) is fed to the Oxidant Reactor 101. Oxygen is introduced separately into the Oxidant Reactor 101 via line 2. Oxidant Reactor 101 can be any vessel suitable for continuously contacting acetaldehyde, oxygen, and the FeAA catalyst under controlled reaction conditions to oxidize acetaldehyde into PAA. The Oxidant Reactor 101 is preferably a simple column that is packed with any suitable packing or trays or it can be a tubular reactor that is packed with static mixers. The liquid containing acetaldehyde and the homogeneous catalyst is mixed with the oxygen gas co-currently at temperature ranging from 40 to 60° C. and pressure ranging from 50 to 150 psig. Operating conditions for the reaction are maintained within these limits in order to yield a reactor effluent that contains 0 to 30 wt % PAA and preferably 5 to 25 wt % PAA. The specific concentration of PAA depends on the requirement of the down-stream Oxidation Reactor 103. Producing the required PAA concentration in the reactor effluent without generating AA and carbon dioxide in the Oxidant Reactor 101 is preferred. The concentration of the catalyst is typically maintained at between 0 to 100 ppm (Fe) and preferably 5 to 10 ppm (Fe). A sufficient amount of fresh acetone is added to the effluent from Oxidant Reactor 101 through line 5 to adjust the PAA concentration and the combined stream is fed to the Oxidant Drum 102 via line 6 where the light gases, such as oxygen, are removed from the liquid mixture through line 7. A portion of line 7 is recycled to the Oxidant Reactor 101 via line 8.

The gas-free oxidant from the Oxidant Drum 102 is fed to the Oxidation Reactor 103 via line 9 to oxidize the oil feed, which is introduced to the Oxidation Reactor 103 through line 10. Since the PAA in acetone is completely miscible in the oil, no phase transfer is required and the PAA reacts quickly with the sulfur and nitrogen compounds in the oil even at low PAA concentrations. The reaction temperature is typically from 0 to 100° C. and preferably from 30 to 50° C. Oxidation Reactor 103 can be any suitable vessel that brings the oil and the liquid oxidant into continuous contact. The Oxidation Reactor 103 is preferably a tubular reactor that is packed with static mixers to provide the requisite mixing and reaction residence time. The tubular reactor can be made from a pipe which is simpler and less expensive than other designs. Pipes are also more space efficient since they can be folded horizontally or vertically.

Oxidation of the sulfur and/or nitrogen compounds in the oil to yield desired levels takes place in the Oxidation Reactor 103; it is most preferred that the hydrocarbon components in the oil remain substantially un-reacted. Preferably the water content in the non-aqueous peroxide oxidant and in the hydrocarbon components, e.g., oil feedstock, should be less than 0.1 wt % and more preferably 0 to 500 ppm. Keeping the amount of water to a minimum helps prevent the formation of solids. The amount of sulfur and/or nitrogen compounds in the oil that must to be oxidized in the Oxidation Reactor 103 depends on the end product specifications. For example, to produce commercial diesel with less than 15 ppm sulfur, essentially complete oxidation of sulfur occurs in the Oxidation Reactor 103. To ensure complete oxidation, excess amounts of the oxidant are used. Given that the stoichiometry requires two moles of PAA for each mole of sulfur that is removed and one mole of PAA for each mole of nitrogen that is removed from the oil, about 1.0 to 5.0 times and preferably from 1.5 to 3.0 times the stoichiometric amount of PAA are used for the oxidation. To minimize the amount of oxidation of the hydrocarbons, the conditions of the Oxidation Reactor 103 including, for example, the reaction temperature and the reactor residence time can be adjusted, e.g., lowered. In addition, the PAA concentration in the oxidant can be optimized by adding or removing the acetones in the diluent. The concentration of PAA in the oxidant is 0 to 30 wt % and preferably 5 to 25 wt % and more preferably 5 to 15 wt %. The residence time in the Oxidation Reactor 103 should be 0 to 30 minutes and preferably 5 to 20 minutes depending on the condition of the reactor, the amount of sulfur and nitrogen that are present in the feedstock, and the level of desulfurization and denitrogenation needed.

The oxidized hydrocarbon feedstock, i.e., oxidized oil, including, for example, diesel, vacuum gas oil, atmospheric residual oil, or crude oil, leaving the Oxidation Reactor 103 is fed to the Flash Drum 104 via line 11 where acetaldehyde and a major portion of the acetone is removed. This removed mixture is introduced to the lower portion of the Stripper Column 106 via line 12 and serves as the stripping gas for removing AA from the oxidized oil. The acetone-reduced oil from the bottom of the Flash Drum 104 is then fed to the Sulfone Extractor 105 via line 13 where it contacts the AA to extract the bulk of the sulfones and nitrogen oxides from the oxidized oil. The Sulfone Extractor 105 can be any continuous multi-stage contacting device, preferably one that is designed for counter-current extraction. Suitable designs, include columns with trays, columns with packings, columns with rotating discs, pulse columns, multi-stage mixers/settlers, and any other rotating type contactors. Preferably, the AA contacts the oil in a counter-current fashion to extract the sulfones and nitrogen oxides at a temperature and pressure from 25 to 150° C. and 0 to 100 psig, respectively, more preferably from 30 to 90° C. and 0 to 50 psig, respectively.

It should be noted that the sulfones and nitrogen oxides are more polar than the unoxidized sulfur and nitrogen compounds from which they were derived and much more polar than any other hydrocarbon components in the oil. In fact, these oxidized sulfur and nitrogen compounds are orders of magnitude more soluble in the extractive solvents than their non-oxidized counterparts. In general, the polarity of the nitrogen oxides are even higher than that of the sulfones, so the nitrogen oxides are mush more easily extracted by the solvent than the sulfones. Therefore, for convenience it is only necessary to considered the sulfones in determining the solvent extraction efficiency.

The raffinate (oil) phase, which comprises mainly oil having reduced amounts of sulfones and nitrogen oxides and minor amounts of AA, is fed to the Stripper Column 106 via line 14 where the AA, acetone and acetaldehyde are stripped from the oil. Since the boiling point of the oxidized oil is much higher than that of AA and that of the lighter compounds and no azeotrope exists in the mixture, the operation of the Stripper Column 106 should be relatively efficient. The extract (acid) phase from the bottom of the Sulfone Extractor 105 is transferred to the Acid Evaporator 108 to recover the AA, acetone, and acetaldehyde from the overhead stream, a portion of which is recycled to the Sulfone Extractor 105 via line 17 as the extractive solvent and the rest of stream is fed to the Acid Recovery Column 107 via line 24. The bottoms from the Acid Evaporator 108, which contain mainly the sulfones and nitrogen oxides along with a minor amount of oil, are withdrawn through line 25 for disposal or further processing. If necessary, a small amount of oil is added via line 32 to the bottom of the Acid Evaporator 108 to aid in the transfer of the bottom stream. The overhead stream from the Stripper Column 106, which contains the AA, acetone, and acetaldehyde, is also fed via line 16 to the Acid Recovery Column 107, where acetone and acetaldehyde are withdrawn from the top of the column and recycled back to the Oxidant Reactor 101 via line 19. Purified AA is taken from the bottom of the Acid Recovery Column 107 and sent to storage through line 20.

The bottom stream from the Stripper Column 106 is fed to the Water Wash Drum 109 via line 21 where the small amount of AA in the oxidized oil is extracted. The wash water is introduced to the Water Wash Drum 109 via line 22. The Water Wash Drum 109 can be any suitable vessel that continuously contacts the oil and wash water, preferably in a counter-current fashion. Multi-stage contacting drums with a water leg for trace solids collection can used. The wastewater is withdrawn from the Water Wash Drum 109 through line 27.

The water-washed oil from the Water Wash Drum 109 is fed via line 26 to the Dryer 110, which can be any drying device, including those that use molecular sieve or salt as the drying agent. The water content in the oil is reduced before it is introduced to the Adsorption Unit 111 via line 28 where final traces of sulfur and nitrogen are removed in order to meet product specifications. Any suitable adsorbent to remove sulfur and nitrogen containing compounds can be employed. For example, U.S. Pat. No. 6,402,940 to Rappas, which is incorporated herein, discloses the use of non-activated alumina which has relatively high surface area for removing sulfones. The non-activated alumina, however, must be regenerated following use. U.S. Pat. No. 6,160,193 to Gore, which is incorporated herein, discloses the use of silica gel and clay filter for removing sulfones.

A preferred adsorbent for the Adsorption Unit 111 to remove sulfones and nitrogen oxides is spent fluid catalytic cracking (FCC) catalyst. The FCC catalysts are designed to accommodate bulky oil molecules in the FCC process, and the FCC cataysts have been shown to exhibit similar adsorbing capacity as the non-activated alumina for the diesel sulfones. The FCC process is a preferred method in the petroleum refining industry for converting higher boiling point petroleum fractions into lower boiling point products, especially gasoline. FCC catalysts include a variety of materials including, for instance, molecular sieves that are naturally-occurring and synthetic non-zeolitic molecular sieves. The FCC process and catalysts are described, for example, in U.S. Pat. No. 6,673,235 to Harris et al., U.S. Pat. No. 5,324,417 to Harandi, and U.S. Pat. No. 5,294,332 to Klotz, which are all incorporated herein by reference.

Typically, in a refinery, the spent FCC catalyst is continuously withdrawn from the cracker and disposed of as a solid waste. The major reason for removal of spent FCC catalyst from the crackers is to control the level of the heavy metals that are deposited on the catalyst which adversely effect catalytic activity. However, the heavy metals have little effect the ability of the catalyst particles to physically adsorb certain size materials as long as the catalyst surface area and pore volume do not change significantly. FCC catalyst, which is originally designed to accommodate the bulky residual oil molecules, shows adsorption properties similar to those of the non-activated alumina for adsorbing the diesel sulfones. FCC catalyst also has a reasonable adsorption capacity for the sulfones and nitrogen oxides from oxidized vacuum gas oil. Since the spent FCC catalyst is essentially cost-free, the sulfones adsorption operation can be carried out without the need for adsorbent regeneration. The sulfone/organic nitrogen oxide-loaded FCC catalyst can simply be discarded without regeneration.

The oil and the spent FCC catalyst can be contacted in a counter-current fashion in a moving solid-bed contactor, where the spent FCC catalyst moves slowly in and out of the contactor. A slurry reactor design can be used for a multi-stage counter-current contactor. Another preferred method of using the spent FCC catalyst is to pelletize the powdered spent FCC catalyst into small spheres or other configurations that can be easily removed from the adsorption unit continuously. The adsorption temperature ranges from 25 to 100° C., and preferably from 30 to 60° C., and the pressure ranges from 0 to 100 psig, and preferably from 0 to 20 psig. The final oil product is withdrawn from the Adsorptioin Unit 111 through line 30. The sulfone/organic nitrogen oxide-loaded spent FCC catalyst can be removed from the Adsorption Unit 111 through line 31 and rinsed with light naphtha to recover the non-adsorbed oil and then heated to recover the light naphtha for recycling. The spent FCC catalyst is fed to the Adsorption Unit 111 continuously through 29.

Figure 2:
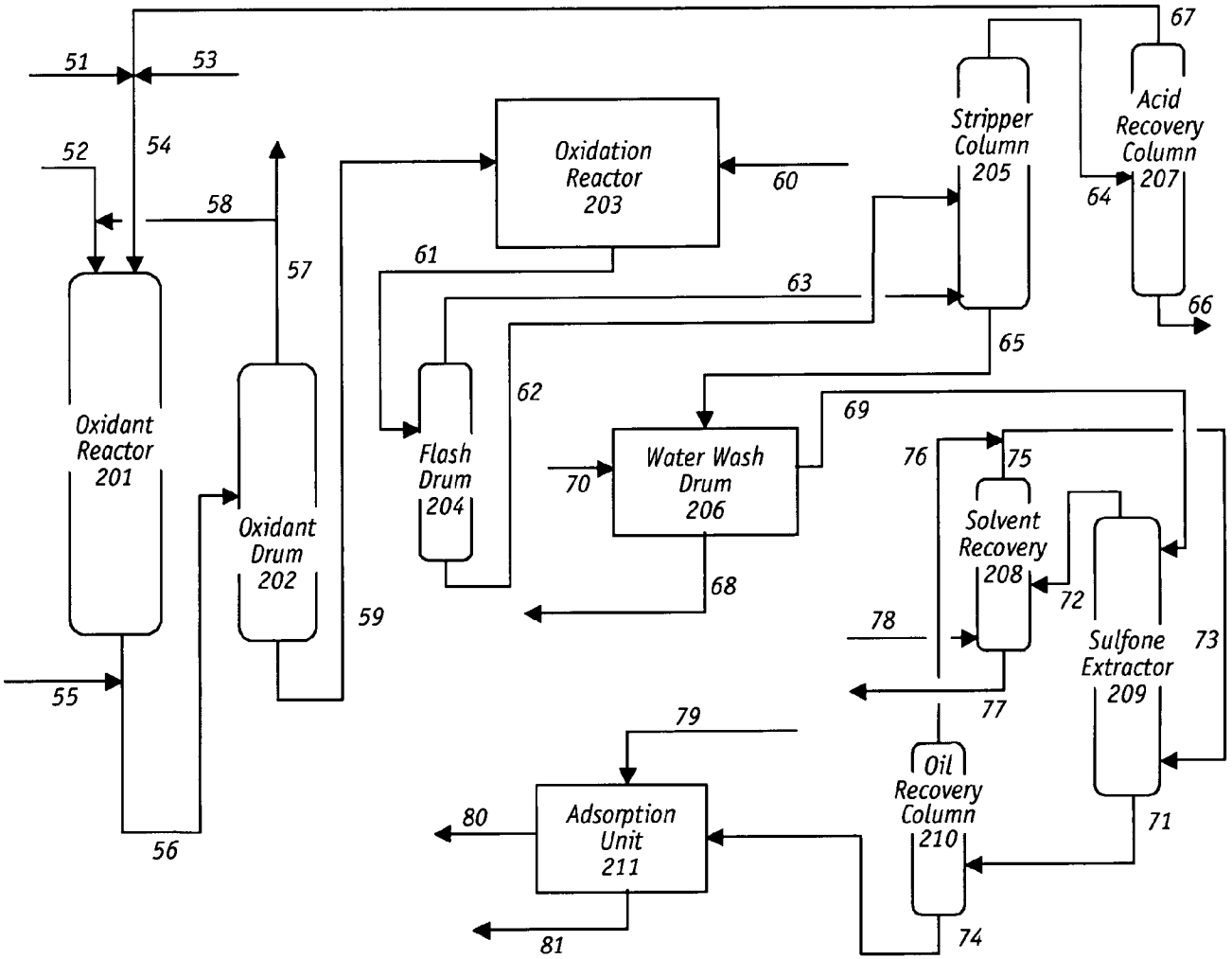
Figure 3A:
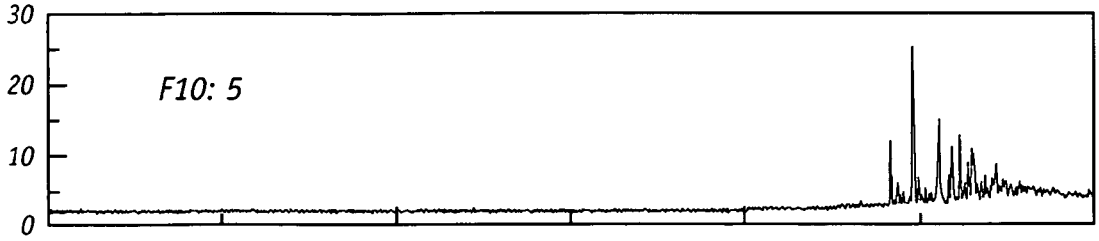
FIGS. 3A-3E are gas chromatography measurements with an atomic emission detector for TLGO oxidation at different PAA concentrations.
Figure 3B:
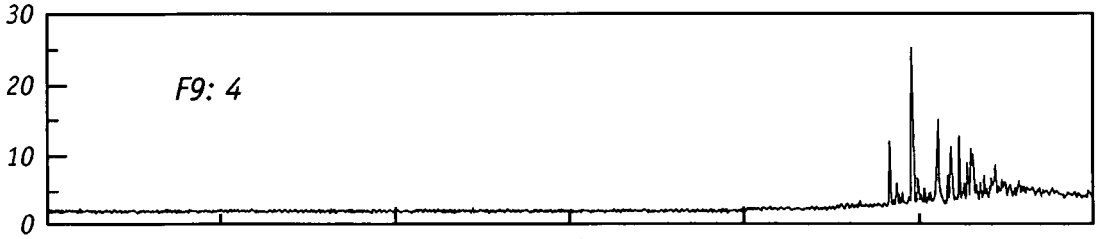
Figure 3C:
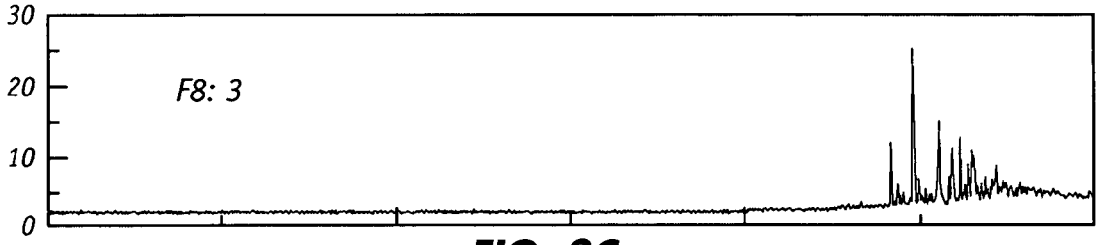
Figure 3D:
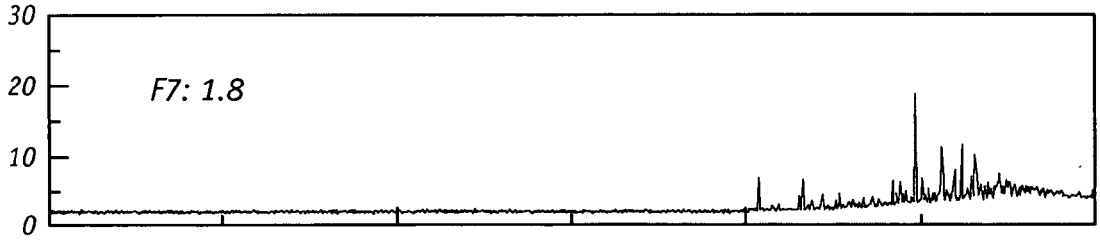
Figure 3E:
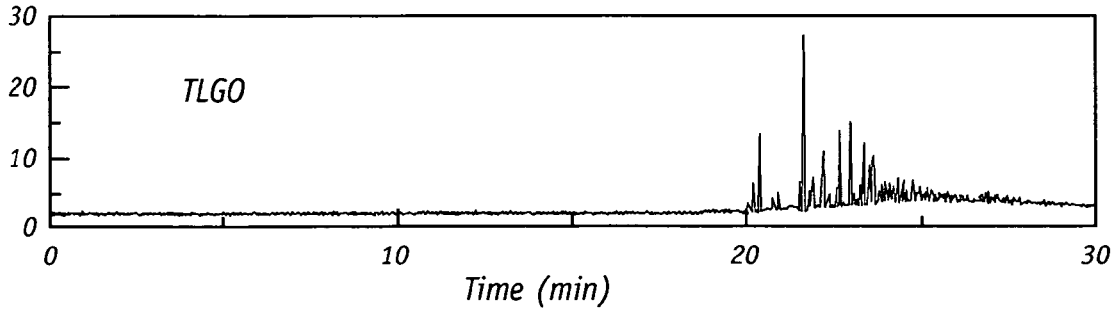

Non In-Situ Process Flow Using Liquid Ammonia or Methanol as the Extraction Solvent FIG. 2 is a flow diagram of an oxidative desulfurization and denitrogenation process for treating oil wherein solvents other than acetic acid are used to extract the bulk of the sulfones and nitrogen oxides from the oxidized hydrocarbon feedstock, e.g., oxidized oil. The same hydrocarbon feedstocks can be processed as in the in-situ method. This process employs an Oxidant Reactor 201, Oxidant Drum 202, Oxidation Reactor 203, Flash Drum 204, Stripper Column 205, Water Wash Drum 206, Acid Recovery Column 207, Solvent Recovery 208, Sulfone Extractor 209, Oil Recovery Column 210, and Adsorption Unit 211 as the major components. Except as otherwise noted herein, the design, construction, and operation parameters of these components are the same as those illustrated in FIG. 1 and described previously.

Referring to FIG. 2, a soluble organoiron compound, such as iron(III) acetylacetonate (FeAA) as a representative catalyst, is introduced via line 51 into line 67 as the homogeneous catalyst, which contains the recycled acetone and acetaldehyde from the overhead of the Acid Recovery Column 207. Fresh acetaldehyde is also mixed into line 67 through line 53 and the combined stream (line 54) is fed to the Oxidant Reactor 201. Oxygen is introduced separately into the reactor via line 52. A sufficient amount of fresh acetone is added to the effluent from the Oxidant Reactor 201 through line 55 to adjust the PAA concentration and the combined stream is fed to the Oxidant Drum 202 via line 56, where the light gases, such as oxygen, are removed from the liquid mixture through line 57. A portion of line 57 is recycled to the Oxidant Reactor 201 via line 58.

The gas-free oxidant from the Oxidant Drum 202 is fed via line 59 to the Oxidation Reactor 203 to oxidize the oil feed, which is introduced to the Oxidation Reactor 203 through line 60. The oxidized hydrocarbon feedstock leaving the Oxidation Reactor 203 is fed to the Flash Drum 204 via line 61 where acetaldehyde and a major portion of the acetone is removed. The removed mixture is introduced to the lower portion of the Stripper Column 205 via line 63 and serves as the stripping gas. The acetone-reduced oil from the bottom of the Flash Drum 204 is also fed via line 62 into the middle portion of the Stripper Column 205 where acetic acid, acetone and the un-reacted acetaldehyde are removed from the oxidized oil as part of the overhead product. To prevent the sulfones and nitrogen oxides from precipitating in the Stripper Column 205, a small amount of AA should remain in the bottom of the column where the AA helps to dissolve the sulfones and nitrogen oxides in the oil. The overhead stream from the Stripper Column 205 is fed to the Acid Recovery Column 207 via line 64. Purified acetic acid is recovered from the bottom stream 66 of the Acid Recovery Column 207, whereas acetone and acetaldehyde is recycled from top of the Acid Recovery Column 207 back to the Oxidant Reactor 201 through lines 67 and 54.

The bottom stream from the Stripper Column 205 is fed to the Water Wash Drum 206 via line 65 where the small amount of AA in the oxidized oil is extracted. The wash water is introduced to the Water Wash Drum 206 via line 70. As the AA becomes essentially completely removed from the oil, at least a portion of the sulfones and nitrogen oxides precipitates from the oil. As mentioned previously, the Water Wash Drum 206 can comprise multi-stage counter-current contacting drums with water leg for solids collection. The precipitated solids can be collected in the water leg and thereafter removed with filters, centrifuge, or other means. Wastewater from the Water Wash Drum 206 is discharged via line 68. Any trace solids suspended in the oil phase can be removed by filtration.

The water-washed oil from the Water Wash Drum 206 is transferred to the Sulfone Extractor 209 where the extractive solvents remove the bulk of the sulfones and nitrogen oxides from the oil. The Sulfone Extractor 209 is preferably a counter-current extractor so the solvent, which is lighter than the oil, is fed to the lower part of the column via line 73 whereas the heavier oil is fed to the upper part of the column via line 69. The operational temperature and pressure of the Sulfone Extractor 209 are determined, in part, by the particular extraction solvent selected.

Two preferred solvents for removing the sulfones and nitrogen oxides are ammonia and methanol; ammonia is particularly preferred. Ammonia and methanol both have: (1) low boiling points for easy solvent recovery, (2) reasonable sulfones solubility for low solvent-to-oil ratio requirements, and (3) excellent thermal stabilities for low solvent consumption.

When employing ammonia, the Sulfone Extractor 209 is pressurized in order to maintain the ammonia in liquid form given that the boiling point of ammonia is approximately −33° C. at atmospheric pressure. The Sulfone Extractor 209 pressure is preferably maintained between 100 to 600 psig and preferably between 150 to 300 psig. The temperature is maintained to ensure that the ammonia solvent is in liquid phase. Ammonia can be recovered as vapor from the overhead stream of the Solvent Recovery Column 208 via line 75 as well as from the overhead stream of the Oil Recovery Column 210 via line 76 by effectively reducing the pressures in both columns. The ammonia vapor in lines 75 and 76 are combined and then compressed into liquid form before being recycled back into the Sulfone Extractor Column 209 through the solvent feed via line 73. Occasionally, a small bleed stream is removed from line 73 in order to remove excess impurities.

When employing methanol as the extractive solvent, the Sulfone Extractor 209 should operate at relatively mild pressures, preferably from 0 to 100 psig and preferably from 0 to 50 psig to allow the extraction temperature to be near or above the normal boiling point of methanol (65° C.). The extraction temperature with methanol ranges from 20 to 100° C. and preferably ranges from 30 to 60° C. The methanol solvent can be recovered from the overhead stream of the Solvent Recovery Column 208 as well as from the overhead stream of the Oil Recovery Column 210 by heating the bottoms of both columns. To handle the heavy and viscous sulfones and nitrogen oxides that accumulates in the bottom of the Solvent Recovery Column 208, it may be necessary to feed a small amount of diluent in the form of diesel or distillates into the bottom of the Solvent Recovery Column 208 via line 78. The diluent facilitates the flow of the bottoms through line 77.

The substantially desulfurized and denitrogenated oil is withdrawn from the bottom of the Oil Recovery Column 210 and then transferred to the Adsorption Unit 211 through line 74 where final traces of sulfur and nitrogen are removed in order to meet product specifications. The preferred adsorbent is spent FCC catalyst, which is described previously. The FCC catalyst is fed to the Adsorption Unit 211 via line 79. The final oil product is withdrawn from the Adsorption Unit 211 through line 80 and the sulfone-loaded spent FCC catalyst is removed via line 81, which can be rinsed with light naphtha to displace the non-adsorbed oil for recovery. The rinsed catalyst can be heated to recover the light naphtha for recycling.

An optional step to the process depicted in FIG. 1 (or FIG. 2) is to use AA as the diluent for the oxidant that is produced in the Oxidant Reactor 101 (or 201). Fresh AA, instead of acetone, is added to the effluent from the Oxidant Reactor 101 (or 201) through line 5 (or line 55). All the light components, including acetaldehyde, acetone, and oxygen are removed from the overhead of the Oxidant Drum 102 (or 202) via line 7 (or line 57). Consequently, the Flash Drum 104 (or 204), Acid Recovery Column 107 (or 207), and the acetone/acetaldehyde recycle line 19 (or line 67) can be eliminated.

EXAMPLES

The following examples are presented to further illustrate the invention and are not to be considered as limiting the scope of this invention.

Example 1

In this example non-aqueous oxidants suitable for the selective oxidation of sulfur and nitrogen compounds in petroleum oils were prepared. A liquid reactant containing 20 vol. % acetaldehyde (AcH), 80 vol. % acetone, and 7 ppm Fe(III) acetylacetone (FeAA) (catalyst) was fed co-currently with chemical grade oxygen gas to the top of a 0.94 cm diameter jacketed reactor column, which was packed with 20-40 mesh ceramic packing material that was 30 cm in length. Water having a constant temperature was circulated through the reactor jacket to control the reaction temperature. The flow rate of the liquid reactant into the reactor was at 1.5 ml per minute and the flow rate of oxygen gas was at 200 ml per minute. Three experimental runs were carried out at temperatures of 39, 45, and 60° C., under a constant reactor pressure of 6.1 atm. The results are summarized in Table 1.

TABLE 1

| Temperature | Product Composition (wt %) | | | | | | AcH Conversion |
|---|---|---|---|---|---|---|---|
| (C. °) | PAA | AA | $H_2O$ | $CO_2$ | AcH | Acetone | (wt %) |
| 39 | 18.6 | 1.8 | Trace | 0.06 | 5.8 | 73.7 | 67.5 |
| 45 | 21.1 | 4.0 | Trace | 0.09 | 4.0 | 70.8 | 77.5 |
| 60 | 24.0 | 3.9 | 0.2 | 0.5 | 2.6 | 68.8 | 82.0 |

The results indicate that an oxidant containing a high PAA concentration of approximately 20 to 25 wt % can be easily produced at temperatures from 40 to 60° C. under mild pressure. To substantially eliminate water in the oxidant, the reaction temperature should be lower than 45° C. Substantially similar results were obtained when other soluble organoiron compounds, such as FeMK or FeEHO, were used instead of FeAA as the oxidation catalyst.

Example 2

A series of oxidation experiments were conducted on a treated light gas oil (TLGO), which had the following composition and properties:

1. Elemental Composition: carbon 86.0 wt %; hydrogen 12.9 wt %; sulfur 301 ppm; and nitrogen 5.0 ppm.
2. Asphaltene: 0 wt %
3. Density: 892 (kg/m$^3$) @15° C.; 875 (kg/m$^3$) @20° C.
4. Viscosity: 6.5 (mPa-s) @20° C.
5. Solid Concentration: 140 ppm TLGO feed was mixed with a sufficient amount of non-aqueous oxidant that was prepared in Example 1 in a glass batch reactor that was equipped with a stirrer. The oxidation was conducted at 50° C. for 15 minutes. The ratios of actual added PAA to the stoichiometric required PAA were varied from 1.8 to 5.0 to determine the optimal ratio for complete oxidation of the sulfur and nitrogen compounds in the TLGO. No phase separation or solid precipitation was observed in any of the runs. The results of gas chromatography (GC) analysis with an atomic emission detector for the original and treated TLGO are presented in FIGS. 3A-3E. The chromatograms clearly show a complete shift of the sulfur peaks forward the heavy end of the chromatogram when the ratios are higher than 1.8, which means that essentially all the sulfur and nitrogen compounds were converted into sulfones and nitrogen oxides under these conditions.

Example 3

602 grams of diesel (D198S) were mixed with a sufficient amount of non-aqueous oxidant that was prepared in Example 1 in a glass batch reactor that was equipped with a stirrer. The added oxidant contained 3.0 times of the stoichiometric amount of PAA needed, i.e., 1.850 grams based on the sulfur content in the diesel, in order to enhance the oxidation reactions with the sulfur and nitrogen compounds. The oxidation was conducted at 60° C. for 15 minutes, and then the reactor content was heated to 130° C. in 15 minutes and maintained at this temperature for 20 minutes. Again, no phase separation or solid precipitation was observed. The oxidized diesel (198S-O3h) was washed with water to remove the minor amounts of AA which was generated from PAA in the oxidation reactor. The yield of diesel from the oxidation step was essentially 100% since the washed diesel (198S-O3hw) weighed approximately 601 grams, which is almost the same weight as the diesel feed. The washed diesel was then dried and passed through an adsorption column containing 30 grams of alumina to remove the sulfones and oxidized nitrogen compounds. Diesel that was substantially free of sulfur and nitrogen (O3HW-1) was obtained after the alumina adsorption.

Figure 4A:
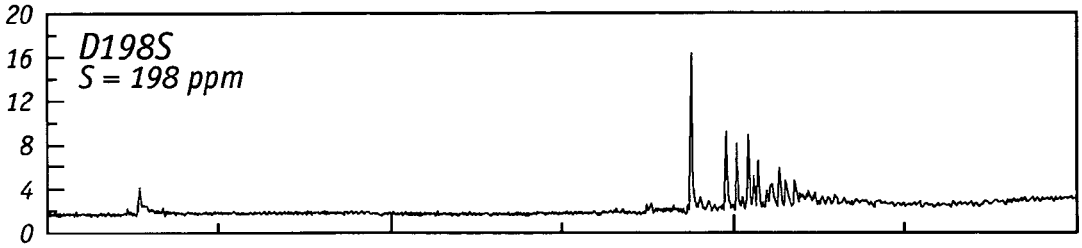
FIGS. 4A-4D are gas chromatography measurements with an atomic emission detector showing the shift in sulfur peaks due to complete oxidation and the disappearing of sulfur peaks due to complete adsorption of the sulfones.
Figure 4B:
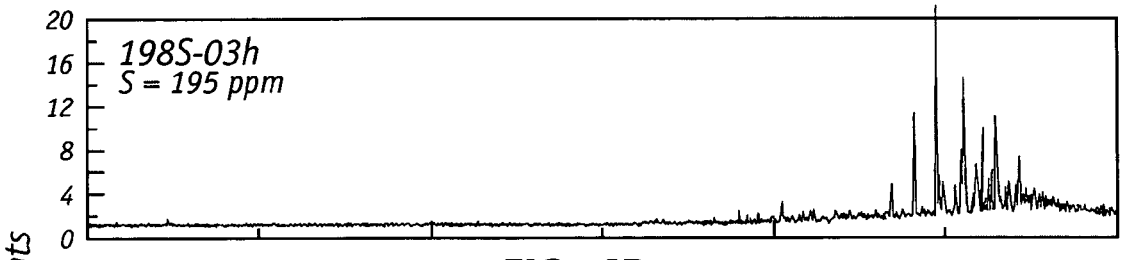
Figure 4C:
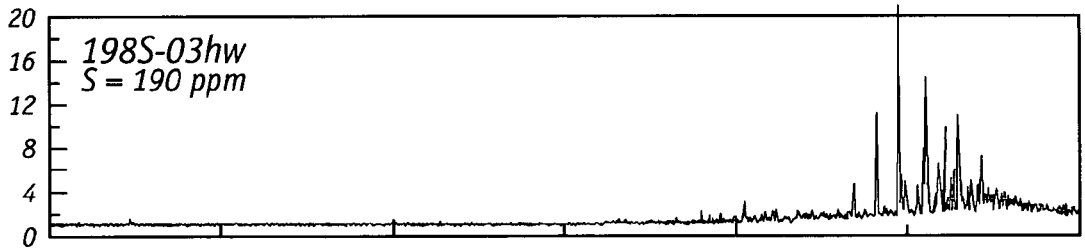
Figure 4D:
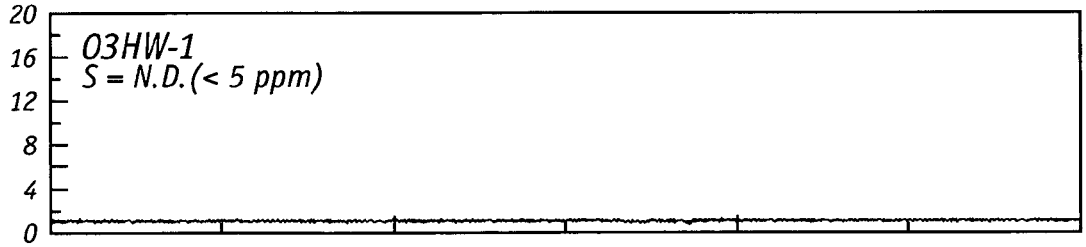

To demonstrate the extent of sulfur oxidation, GC analysis with an atomic emission detector was used to analyze the diesel samples (D198S, 198S-O3h and 198S-O3hw). As shown in FIGS. 4A-4C, the sulfur peaks in the oxidized diesel (198S-O3h and 198S-O3hw) completely shifted forward the heavy end of the chromatogram, indicating a total oxidation of the sulfur species in the diesel feed. FIG. 4D also shows that the sulfur peaks disappeared totally from the diesel after alumina adsorption, indicating excellent performance of the alumina in selectively removing the sulfones from diesel. Table 2 compares the properties of the original diesel feed (D198S) with those of the diesel product (O3HW-1) following oxidation, water washing, and alumina adsorption.

TABLE 2

| Diesel Properties | Diesel Feed (D198S) | Diesel Product (O3HW-1) | Method |
|---|---|---|---|
| Density @ 15.5° C. | 0.826 g/ml | 0.824 g/ml | ASTM D5002 |
| Flash Point | 95° C. | 95° C. | ASTM D93 |
| Pour Point | −15° C. | −15° C. | ASTM D97 |
| Kinematic Viscosity @ 40° C. | 2.847 cSt | 2.812 cSt | ASTM D445 |
| Water & Solids | 0.00 vol % | 0.00 vol % | ASTM 1796 |
| Cetane Index | 54.9 | 55.5 | ASTM D976 |
| Corrosivity 3 hr (at 50° C.) | 1a | 1a | ASTM D130 |
| Rams Bottom Residue | 0.09 wt % | 0.04 wt % | ASTM D524 |
| Ash | 0.002 wt % | 0.001 wt % | ASTM D482 |
| Boiling Range (° C.) | | | |
| IBP | 218.4 | 217.3 | |
| 10 vol % | 235.1 | 235.2 | |
| 20 vol % | 243.2 | 243.1 | |

TABLE 2-continued

| Diesel Properties | Diesel Feed (D198S) | Diesel Product (O3HW-1) | Method |
|---|---|---|---|
| 50 vol % | 264.8 | 264.4 | |
| 90 vol % | 319.7 | 317.8 | |
| End Point | 358.4 | 359.1 | |
| Residue | 1.6 vol % | 1.6 vol % | |
| Sulfur | 198 ppm* | <5 ppm** | |

*ASTM D2622
**ASTM D5453

The data demonstrate that the non-aqueous oxidation process is very effective in removing the difficult sulfur, e.g., multi-ring thiophenic, and nitrogen compounds from the oil to non-detectable level (<5 ppm) while, at the same time, not adversely effecting characteristics of the oil.

Example 4

This example demonstrates the oxidation of a heavy diesel that contained very high levels of sulfur (1.61 wt %) and nitrogen (213 ppm). A non-aqueous oxidant (PAA) that was prepared from the oxidation of AA by hydrogen peroxide was used. In a reactor, 354 grams of heavy diesel was mixed with 77.3 grams of the oxidant, which contained 39 wt % PAA, 6 wt % hydrogen peroxide, and 55 wt % AA. The added PAA was equivalent to 1.1 times of the stoichiometric PAA required for the oxidation of sulfur. (This is lower than the amount suggested in Example 2 for complete oxidation.) Due to the exceptional highly sulfur content in the oil feed, the amounts of added AA (from the oxidant) and generated AA (from PAA in the oxidant) were together too high to keep the reaction mixture in a single phase. Therefore, approximately 88 grams of acetone was also added to the reactor to minimize phase separation. The reactor was kept at 40° C. initially but the temperature rose to 49° C. as the oxidation reaction progressed. The reactions were terminated after 20 minutes.

Approximately 357 grams of the oxidized diesel containing 0.742 wt % sulfur, 64 ppm nitrogen, 2.0 wt % AA, and 4.8 wt % acetone, was collected from the diesel phase. No solid precipitation was detected in the reactor effluent. The oxidized diesel was then washed with 600 grams of water to completely remove the AA and acetone to obtain 332 grams of diesel containing 0.818 wt % sulfur and 68 ppm nitrogen. The results from GC analysis with an atomic emission detector on the diesel samples before and after oxidation showed a distinct shift of the sulfur peaks to the heavy end which suggest that significant oxidation of the sulfur and nitrogen compounds occurred.

Example 5

This example demonstrates the use of liquid-liquid extraction to remove the bulk of the sulfur (in the form of sulfones) and nitrogen (in the form of nitrogen oxides) from the oxidized oil. TLGO with 307 ppm sulfur was oxidized at 50° C. in 15 minutes with PAA as the non-aqueous oxidant wherein the amount of PAA used was 1.1 times that of the stoichiometric amount. The sulfur and nitrogen were extracted from the oxidized TLGO with each of acetic acid, methanol, and water. Water was used as a comparative baseline reference. The oil feed was mixed with the solvent at an oil-to-solvent weight ratio of 1:1 in a separatory funnel, which was well shaken at room temperature. For all three solvents, the phases separated quickly without any difficulty and the oil phase was analyzed for total sulfur content. In addition, orginal (unoxidized) TLGO was subject to extraction with AA. The results of the three one-stage solvent extractions are summarized in Table 3.

TABLE 3

| Sample Identification | Total Sulfur in Oil Phase (ppm) | | |
|---|---|---|---|
| | AA | Methanol | Water (reference) |
| Original TLGO (reference) | 232 | — | — |
| Oxidized TLGO | 159 | 181 | 300 |

Water has essentially no extraction capabilities for the sulfones since the amount of sulfur in the oxidized oil after water extraction was still at 300 ppm as compared to 307 ppm before the extraction. Extraction of the sulfones from oxidized TLGO by AA, reduced the sulfur level substantially from 307 to 159 ppm. In comparison, the sulfur level was only reduced from 307 ppm to 232 ppm when the the original TLGO was mixed with the AA. As is apparent, at least with respect to AA, solvent extraction is more effective in removing the oxidized sulfur compounds which are mainly sulfones. Finally, it was found that AA has better selectivity than methanol for extracting the oxidized sulfur compounds, since methanol only changed the sulfur content for the oxidized TLGO from 307 to 181 ppm.

Diesel (or TLGO) that is extracted into the solvent phase is difficult to recover, this phenomenon is considered to contribute to the overall yield loss for the diesel (or TLGO) in any process. Experiments were conducted to determine the solubilities of diesel in AA and methanol by mixing excess amounts of diesel in each of AA and methanol and allowing equilibrium to establish at room temperature. After phase separation, the solvent phase was analyzed for diesel content. The solubilities of diesel in AA and methanol were found to be 2.0 and 7.0 wt %, respectively. In contrast, AA is the better solvent for extracting the sulfones in oxidized diesel.

Example 6

In this example, TLGO was oxidized using different amounts of PAA and, thereafter, the various oxidized TLGO samples were subject to extraction using AA to remove the sulfur, in the form of sulfones, from the oxidized TLGO samples. Specifically, TLGO was oxidizied using different amounts of PAA (actual PAA) that ranged from 1.1 to 5.0 times the calculated stoichiometric amount of PAA needed (stoich PAA). The oxidation reaction temperature was 50° C. and the reaction time was 15 minutes. Each oxidized TLGO sample was subject to a one-stage solvent extraction where the sample was mixed with an amount, by weight, of AA that was equal to that of the oxidized TLGO sample. The sulfur content in the oil was analyzed. The results are presented in Table 4.

TABLE 4

| Actual PAA/Stoich PAA | Sulfur in Oil phase After Oxidation |
|---|---|
| 1.1 | 156 |
| 1.2 | 138 |
| 1.4 | 125 |
| 1.6 | 116 |
| 1.8 | 108 |
| 3.0 | 90 |
| 4.0 | 89 |
| 5.0 | 88 |

The results indicate that AA extraction can reduce the sulfur content in TLGO from the 307 ppm (original TLGO) to approximately 90 ppm in a one-stage extraction. The actual PAA to stoichiometric PAA ratio used in the oxidation should be in the range of 1.8 to 3.0. This amount of PAA should be sufficent to attain almost complete, i.e, 100%, oxidation of the sulfur and nitrogen compounds in the oil.

Example 7

This example shows the extraction capacity of AA in removing sulfur from partially oxidized TLGO. Specifically, TLGO with 307 ppm sulfur was oxidized at a temperature of 50° C. in 15 minutes using PAA as the oxidant. The amount of PAA used was equal to 1.1 times the calculated stoichiometric PAA amount needed. Thereafter, samples of the partially oxidized TLGO were mixed with AA, with each sample being mixed with a different relative amount AA at room temperature. That is, the ratio of solvent-to-oil was different for each extraction. The extraction procedure used was the same as that described in Example 5. The extraction results are summarized in Table 5.

TABLE 5

| Solvent-to-oil ratio (wt) | Sulfur in Oil Phase (ppm) |
|---|---|
| 0.17 | 250 |
| 0.25 | 220 |
| 0.50 | 185 |
| 1.0 | 150 |
| 2.0 | 120 |

As is apparent, the one-stage extraction results further demonstrate the effectiveness of using AA as an extraction solvent for removing the sulfur (and nitrogen) from oxidized oil.

Example 8

This example shows the extraction capacity of AA for removing sulfur from partially and completely oxidized TLGO in a multi-stage liquid-liquid extraction scheme at room temperature. TLGO with a sulfur content of 307 ppm was oxidized at 50° C. in 15 minutes with PAA. The amount of PAA used was either 1.6 or 2.5 times the calculated stoichiometric amount of PAA needed. In each case, the oxidized TLGO sample was extracted with AA according to the following procedure:

(1) The oxidized TLGO was mixed with AA in a separatory funnel where the AA-to-TLGO weight ratio of of the mixture was 0.25. The mixture was well shaken at room temperature.

(2) The distinct phases separated quickly without difficulty.

(3) Both the AA (extract) phase and the oil (raffinate) phase were weighed.

(4) Fresh AA was added to the oil phase at AA-to-TLGO ratio of 0.25 again and the mixture was well shaken. Steps 3 and 4 were repeated to stimulate a multi-stage cross-flow extraction scheme.

The extraction results are summarized in Table 6.

TABLE 6

| AA-to-TLGO Ratio: 0.25 | | |
|---|---|---|
| | Actual PAA/Stoichiometric PAA | |
| Extraction Stage | 1.60 (Sulfur in oil phase (ppm)) | 2.50 |
| 0 | 294 | 292 |
| 1 | 210 | 204 |
| 2 | 138 | 125 |
| 3 | 101 | 80 |
| 4 | 77 | 52 |
| 5 | 63 | |
| 6 | 53 | |

The results show that the sulfones can be efficiently extracted from the oil with AA in a multi-stage cross-flow extraction scheme. The results are good even at a very low AA-to-oil ratio. The sulfur in the completely oxidized oil (with Actual PAA/Stoich PAA=2.50) is easier to extract than the sulfur in the partially oxidized oil (with Actual PAA/Stoich PAA=1.60).

Example 9

This example shows the extraction capacity of ammonia ($NH_3$) for removing sulfur from oxidized TLGO at various solvent-to-oil ratios at room temperature. TLGO with a sulfur content of 307 ppm was oxidized at 50° C. in 15 minutes using PAA as the oxidant. The amount of PAA was 1.6 times the calculated stoichiometric amount of PAA needed. The experimental procedures are as follows:

(1) The oxidized TLGO was washed twice with equal amounts of distilled water to remove any AA that was generated in the oxidation step.
(2) The washed TLGO was mixed under pressure with liquid $NH_3$ at a determined $NH_3$-to-TLGO ratio at room temperature.
(3) The mixture was shaken in a shaker for 28 hours, thereafter, the shaker was stopped and the phases allowed to separate.
(4) The oil phase was drained after 2 hours of phase separation.
(5) The pressure in the oil sample was released to allow the $NH_3$ to vaporize.
(6) The oil sample was subject to total sulfur analysis.

The extraction results at different $NH_3$-to-TLGO weight ratios are presented in Table 7.

TABLE 7

| $NH_3$-to-TLGO Ratio (wt) | Sulfur in TLGO Phase |
|---|---|
| 0.00 | 298 |
| 0.40 | 242 |
| 0.76 | 210 |
| 1.37 | 187 |

The one-stage extraction results demonstrate the effectiveness of liquid $NH_3$ as the extraction solvent for removing the sulfur (and nitrogen) from the oxidized oil.

Another advantage of the liquid $NH_3$ is its low mutual solubility with the oil, which is lower than that of AA and much lower than that of methanol. Under the $NH_3$-to-TLGO weight ratio from 0.40 to 1.37, the solubility of $NH_3$ in TLGO was 2.7 to 3.0 wt %; the solubility of TLGO in $NH_3$ was approximately 1.7 wt %. The low solubility of TLGO in $NH_3$ results in lower oil yield loss.

Example 10

This example demonstrates and compares the adsorption of sulfur (mainly sulfones) from oxidized and water-washed commercial diesel (D198S-1W) using spent FCC catalyst and non-activated alumina as the adsorbents. The physical properties of the spent FCC catalyst and non-activated alumina are summarized in Table 8.

TABLE 8

| Physical Properties | Spent FCC Catalyst | Non-activated Alumina |
|---|---|---|
| Surface Area ($m^2/g$) | 159 | 128 |
| Pore Volume ($cm^3/g$) | 0.16 | 0.26 |
| Average Particle Size (mm) | 0.100 | 0.006–0.200 |
| 0–100 μm | 61.5% | |
| 0–80 μm | 40.1% | |
| 0–40 μm | 1.7% | |
| 0–20 μm | 0.2% | |
| Zeolite/Matrix | 94/44 | |
| Ni (ppm) | 3270 | |
| V (ppm) | 4140 | |
| Alumina | 34.8 wt % | |
| Silica | 59.2 wt % | |

The commercial diesel (D198S), with the properties shown in Table 2, was oxidized according to the oxidation procedure described in Example 2. The adsorbents were preheated at 450° C. overnight in a vacuum drying oven before use. Approximately 30 grams of dried adsorbent was packed into a 1.2 cm diameter glass column. If elevated temperatures were required for the adsorption, heating was provided by a heating tape, which was wrapped around the column. Oxidized commercial diesel was fed to the top of the column at a constant flow rate, which was controlled by a hand valve at the bottom of the column. Weighed samples were collected for determining the total sulfur and nitrogen contents and for GC analysis of the sulfur spectrum. The sample weights and the corresponding sulfur contents are presented in Table 9.

TABLE 9

| Adsorbent | Sample collected (wt %) | Sulfur (ppm) | Nitrogen (ppm) |
|---|---|---|---|
| 1. Oxidized Oil Feed (D198S-1W) | | | |
| Alumina | 10.72 | 13 | <2 |
| | 12.78 | 12 | <2 |
| | 9.45 | 15 | <2 |
| | 16.75 | 16 | <2 |
| | 25.30 | 16 | <2 |
| | 25.00 | 14 | <2 |
| | (No breakthrough occurred) | | |
| Spent FCC Catalyst (RDS-600) | 36.09 | 21 | <2 |
| | 31.40 | 33 | <2 |
| | 32.51 | 3.2 | <2 |
| | (No breakthrough occurred) | | |
| 2. Un-oxidized Oil Feed (D198S) | | | |
| Alumina | 12.71 | 46 | <2 |
| | 13.22 | 92 | <2 |
| | 20.28 | 123 | <2 |
| | 18.72 | 115 | <2 |
| | 35.07 | 123 | <2 |
| | (Breakthrough detected after two sample collections) | | |

Both the alumina and the spent FCC catalyst showed good results for removing sulfur and nitrogen from the oxidized commercial diesel. While the spent FCC catalyst showed slightly higher sulfur in the first two samples collected, the third sample yielded substantially lower sulfur content. Not surprisingly, for the un-oxidized oil, the samples collected from the alumina bed showed substantially higher sulfur content. Sulfur breakthrough occurred after first two sample collections.

Example 11

This example shows and compares the adsorption of sulfur frome oxidized ultra-high sulfur heavy diesel (HD-A-hDW) using spent FCC catalyst as well as non-activated alumina as the adsorbents. The heavy diesel was oxidized according to the oxidation procedure described in Example 4. The adsorption experimental procedure used as that summarized in Example 10. Again, weighed samples were collected for determining total sulfur and nitrogen content and for GC analysis of the sulfur spectrum. The sample weights and the corresponding sulfur contents are presented in Table 10:

TABLE 10

| Adsorbent | Sample collected (wt %) | Sulfur (wt %) | Nitrogen (ppm) |
|---|---|---|---|
| Alumina | 20.63 | 0.162 | <1 |
| | 28.25 | 0.373 | 12 |
| | 25.54 | 0.768 | 18 |
| | 25.58 | 0.792 | 26 |
| Spent FCC | 18.10 | 0.118 | <1 |
| Catalyst | 23.22 | 0.32 | — |
| | 58.67 | 0.74 | — |

The above results indicate that the adsorption method was not suitable for high sulfur oil feed, regardless of whether the sulfur and nitrogen compounds were oxidized or not, and regardless of which adsorbent was used. The bulk of the sulfur and nitrogen in high sulfur oil, after oxidation, should be removed by other means, such as liquid-liquid extraction, before the adsorption method is employed for final residual sulfur and nitrogen removal.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A process for removing sulfur-containing compounds and nitrogen-containing compounds from a liquid hydrocarbon feedstock, that comprises the steps of:

(a) contacting the liquid hydrocarbon feedstock in an oxidation reactor with a non-aqueous oxidant that comprises peracetic acid in acetone to selectively oxidize the sulfur-containing compounds into sulfones and the nitrogen-containing compounds into nitrogen oxides whereby an acetic acid by-product is produced when the sulfur-containing compounds and the nitrogen-containing compounds are oxidized wherein the water content in each of the non-aqueous oxidant and the liquid hydrocarbon feedstock is less than 0.1 wt % which prevents solid precipitations in the oxidation reactor and which prevents phase separation caused by the presence of excessive water; and (b) removing the sulfones and nitrogen oxides by extraction with the acetic acid by-product that is produced in step (a).

2. The process of claim 1 wherein step (a) comprises contacting the hydrocarbon feedstock with a mixture comprising a non-aqueous peracetic acid oxidant, acetone and acetaldehyde in an oxidation reactor and step (b) comprises the steps of:

(i) removing acetone to generate an acetone-reduced effluent stream and an acetone stream;

(ii) contacting the acetone-reduced effluent stream with the acetic acid by-product to extract the bulk of the sulfones and nitrogen oxides from the acetone-reduced effluent steam whereby (1) an extract phase containing the acetic acid by-product, sulfones and nitrogen oxides is generated and (2) an extractor raffinate phase, that contains acetic acid by-product and acetaldehyde, is generated;

(iii) recovering the acetic acid by-product from the extract phase by evaporation or other means and recycling at least a part of the acetic acid by-product for reuse in step (ii);

(iv) stripping acetic acid by-product and acetaldehyde from the extractor raffinate phase with acetone from the acetone stream of step (i) and generating a desulfurized and denitrogenated hydrocarbon feedstock.

3. The process of claim 2 further comprising the steps of:

(v) purifying the acetic acid by-product that is stripped in step (iv) by removing acetone and acetaldehyde therefrom;

(vi) washing the desulfurzied and denitrogenated hydrocarbon feedstock to remove additional acetic acid by-product; and (vii) removing additional sulfones and nitrogen oxides from the washed hydrocarbon feedstock from step (vi) by adsorption to yield a hydrocarbon feedstock product with desired sulfur and nitrogen levels.

4. The process of claim 1 wherein the hydrocarbon feedstock is liquid hydrocarbon fuel, vacuum gas oil, atmospheric residual oil, or crude oil.

5. The process of claim 1 wherein the peracetic acid is prepared by catalytic oxidation of acetaldehyde with molecular oxygen.

6. The process of claim 1 wherein the peracetic acid is prepared by oxidizing acetic acid with an aqueous hydrogen peroxide solution to produce peracetic acid in solution and thereafter dehydrating the solution to yield the peracetic acid.

7. The process of claim 1 wherein the peracetic acid is prepared by mixing acetaldehyde (AcH) in acetone to form a mixture and then oxidizing the AcH with molecular oxygen to produce peracetic acid.

8. The process of claim 7 wherein oxidizing the AcH with molecular oxygen is catalyzed by an organoiron (III) homogenous catalyst.

9. The process of claim 8 wherein the catalyst is a soluble organoiron(III) compound that is selected from the group consisting of Fe(III) acetylacetonate, Fe(III) ethylhexanoate, ferrocenyl methyl ketone, and mixtures thereof.

10. The process of claim 8 wherein the catalyst is added to the mixture in a concentration ranging from 0.1 to 10,000 ppm (Fe).

11. The process of claim 7 wherein the step of oxidizing the AcH with molecular oxygen occurs at a reaction temperature and pressure of 0 to 100° C. and 0 to 200 psig, respectively, to yield a product that contains up to about 30 wt % peracetic acid.

12. The process of claim 8 wherein step (a) comprises contacting the AcH in an oxidant reactor and wherein the oxidant reactor continuously contacts the acetaldehyde and the soluble organoiron(III) homogenous catalyst with gaseous oxygen.

13. The process of claim 1 wherein the sulfur-containing compounds and the nitrogen-containing compounds in the liquid hydrocarbon feedstock are oxidized by peracetic acid in an acetone medium and the oxidation occurs at a reaction temperature and pressure 0 to 150° C. and from 0 to 200 psig, respectively.

14. The process of claim 13 wherein 1.0 to 5.0 times the theoretical stochiometric amount of peracetic acid, which is calculated on the basis of sulfones and nitrogen oxides formation, are used in step (a) to oxidize substantially all of the sulfur-containing compounds and nitrogen-containing compounds in the liquid hydrocarbon feedstock.

15. The process of claim 13 the residence time in the oxidation reactor is up to about 30 minutes.

16. The process of claim 13 wherein step (a) comprises contacting the hydrocarbon feedstock in an oxidation reactor and the oxidation reactor continuously contacts the liquid hydrocarbon feedstock and the peracetic acid.

17. The process of claim 2 wherein step (i) comprises feeding the reactor effluent to a flash drum or an evaporator to vaporize acetaldehyde and a major portion of acetone which is then used as stripping gas in step (iv) to remove acetic acid from the extractor raffinate phase.

18. The process of claim 2 wherein step (ii) comprises feeding the acetone-reduced effluent stream to a liquid-liquid extractor to remove the bulk of the sulfones and nitrogen oxides with the acetic acid by-product.

19. The process of claim 18 wherein the liquid-liquid extractor operates at a pressure range of 0 to 100 psig and a temperature range of 25 to 150° C.

20. The process of claim 18 wherein the liquid-liquid extractor is a multi-stage vessel that continuously contacts the acetone-reduced effluent stream with the acetic acid.

21. The process of claim 2 wherein both the acetic acid and the acetaldehyde are recovered in step (iii) using an evaporator.

22. The process of claim 21 wherein a small amount of diesel or distillate is fed to a bottom portion of the evaporator to aid the transferring of accumulated heavy and viscous sulfones and nitrogen oxides from the bottom portion of the evaporator.

23. The process of claim 2 wherein the acetic acid is stripped from the extractor raffinate phase in step (iv) using recovered acetone as the stripping gas.

24. The process of claim 23 wherein in step (iv) a mixture containing acetic acid, acetone, and acetaldehyde is distilled to recover acetone and acetaldehyde for reuse and to recover acetic acid as a by-product.

25. The process of claim 3 wherein step (vi) comprises washing with water to remove residual acetic acid from the desulfurized and denitrogenated hydrocarbon feedstock in multi-stage counter-current contacting drums that are equipped with one or more water legs to collect solid precipitations that can form as acetic acid is removed from the desulfurized and denitrogenated hydrocarbon feedstock.

26. The process of claim 3 wherein step (v) comprises adsorbing residual sulfones and nitrogen oxides with an absorbent that is selected from the list consisting of spent fluid catalytic cracking (FCC) catalyst, non-activated alumina, silica gel, and mixtures thereof.

27. The process of claim 26 wherein the absorbent is spent FCC catalyst which is fed to an adsorber to contact the washed hydrocarbon feedstock in a counter-current fashion in a moving solid-bed contactor wherein the spent FCC catalyst moves slowly in and out of the contactor.

28. The process of claim 27 wherein the spent FCC catalyst is not regenerated after its adsorption capacity is reached.

29. The process of claim 27 wherein sulfone-loaded spent FCC catalyst is removed from the adsorber and is rinsed with light naphtha to displace non-adsorbed hydrocarbon feedstock for recovery and the rinsed catalyst is then heated to recover the light naphtha for recycling.

30. A process, for removing sulfur-containing compounds and nitrogen-containing compounds from a liquid hydrocarbon feedstock, that comprises the steps of:

(a) contacting the liquid hydrocarbon feedstock in an oxidation reactor with a non-aqueous peracetic acid oxidant mixture that contains a peracetic acid, acetone, and acetaldehyde to selectively oxidize the sulfur-containing compounds into sulfones and the nitrogen-containing compounds into nitrogen oxides whereby an acidic acid by-product is produced when the sulfur-containing compounds and the nitrogen-containing compounds are oxidized, whereby generating an oxidized hydrocarbon feedstock stream wherein the water content in each of the non-aqueous peracidic acid oxidant mixture and the liquid hydrocarbon feedstock is less than 0.1 wt % which prevents solid precipitations in the oxidation reactor and which prevents phase separation caused by the presence of excessive water;

(b) removing the acidic acid by-product, acetone, and acetaldehyde from the oxidized hydrocarbon feedstock stream to yield (1) a second oxidized hydrocarbon feedstock stream (2) an acidic acid by-product stream and (3) a acetone stream; and (c) removing the bulk of the sulfones and nitrogen oxides from the second oxidized hydrocarbon feedstock stream to yield a first desulfurized and denitrogenated hydrocarbon feedstock stream; and (d) treating the first desulfurized and denitrogenated hydrocarbon feedstock stream by absorption to further reduce the sulfur and nitrogen contents to produce a hydrocarbon feedstock product with desired sulfur and nitrogen levels.

31. The process of claim 30 further comprising the step of washing the second oxidized hydrocarbon feedstock stream from step (b) to further remove acidic acid by-products prior to step (c).

32. The process of claim 30 further comprising the step of removing acetone and acetaldehyde from the organic acid by-product stream.

33. The process of claim 30 wherein step (b) comprises transferring the oxidized hydrocarbon feedstock stream into an evaporator or distillation column to remove the acidic acid by-product, acetone, and acetaldehyde.

34. The process of claim 30 wherein the hydrocarbon feedstock is liquid hydrocarbon fuel, vacuum gas oil, atmospheric residual oil, or crude oil.

35. The process of claim 30 wherein the peractic acid is prepared by catalytic oxidation of acetaldehyde with molecular oxygen.

36. The process of claim 30 wherein the non-aqueous peracetic acid is prepared by oxidizing acidic acid with an aqueous hydrogen peroxide solution to produce peracetic acid in solution and thereafter dehydrating the solution to yield the peracetic acid.

37. The process of claim 30 wherein the peracidc acid is prepared by mixing acetaldehyde (AcH) in acetone to form a mixture and then oxidizing the AcH with molecular oxygen to produce peracetic acid.

38. The process of claim 37 wherein oxidizing the AcH with molecular oxygen is catalyzed by an organoiron (III) homogenous catalyst.

39. The process of claim 38 wherein the catalyst is a soluble organoiron(III) compound that is selected from the group consisting of Fe(III) acetylacetonate, Fe(III) ethylhexanoate, ferrocenyl methyl ketone, and mixtures thereof.

40. The process of claim 38 wherein the catalyst is added to the mixture in a concentration ranging from 1 to 10,000 ppm (Fe).

41. The process of claim 37 wherein the step of oxidizing the AcH with molecular oxygen occurs at a reaction temperature and pressure of 0 to 100° C. and 0 to 200 psig, respectively, to yield a product that contains up to about 30wt % peracetic acid.

42. The process of claim 38 wherein step (a) comprises contacting AcH in an oxidant-reactor and wherein the oxidant reactor continuously contacts the acetaldehyde and the soluble organoiron(III) homogenous catalyst with gaseous oxygen.

43. The process of claim 30 wherein the non-aqueous peracetic acid oxidant mixture comprises peracetic acid in an acetone medium and the oxidation occurs at a reaction temperature and pressure 0 to 150° C. and from 0 to 200 psig, respectively.

44. The process of claim 43 wherein 1.0 to 5.0 times the theoretical stochiometric amount of peracid acid which is calculated on the basis of sulfones and nitrogen oxides formation, are used in step (a) to oxidize substantially all of the sulfur-containing compounds and nitrogen-containing compounds in the liquid hydrocarbon feedstock.

45. The process of claim 43 wherein the residence time in the oxidation reactor is up to about 30 minutes.

46. The process of claim 43 wherein step (a) comprises contacting the hydrocarbon feedstock in an oxidation reactor and the oxidation reactor continuously contacts the liquid hydrocarbon feedstock and the non-aqueous peracetic acid oxidant mixture.

47. The process of claim 30 wherein step (b) comprises removing acetic acid and acetaldehyde in a stripping column or distillation column wherein a portion of acetic acid is kept in the bottom of the stripping column or the distillation column to prevent precipitation of the sulfones and nitrogen oxides.

48. The process of claim 47 wherein prior to step (b) the oxidized hydrocarbon feedstock is fed to a flash drum to vaporize acetaldehyde and the major portion of acetone which are used as a stripping gas to remove acetic acid in the stripping column or distillation column.

49. The process of claim 30 wherein the step (c) comprises feeding the second oxidized hydrocarbon feedstock stream into a liquid-liquid extraction unit to removed the bulk of the sulfones and nitrogen oxides with an extraction solvent comprising liquid ammonia or methanol.

50. The process of claim 49 wherein the extraction solvent is ammonia and the extractor unit has a pressure in the range of 100 to 600 psig and a temperature range to ensure that the ammonia solvent is in liquid phase.

51. The process of claim 49 wherein the extraction solvent is methanol and the extractor unit has a pressure in the range of 0 to 100 psig and a temperature in the range of 20 to 100° C.

52. The process of claim 30 wherein step (d) comprises adsorbing residual sulfones and nitrogen oxides with an absorbent that is selected from the list consisting of spent fluid catalytic cracking (FCC) catalyst, non-activated alumina, silica gel, and mixtures thereof.

53. The process of claim 52 wherein the absorbent is spent FCC catalyst which is fed to an adsorber to contact the washed hydrocarbon feedstock in a counter-current fashion in a moving solid-bed contactor wherein the spent FCC catalyst moves slowly in and out of the contactor.

54. The process of claim 53 wherein the spent FCC catalyst is not regenerated after its adsorption capacity is reached.

55. The process of claim 53 wherein sulfone-loaded spent FCC catalyst is removed from the adsorber and is rinsed with light naphtha to displace non-adsorbed hydrocarbon feedstock for recovery and the rinsed catalyst is then heated to recover the light naphtha for recycling.

* * * * *